US010712132B2

(12) United States Patent
Miller et al.

(10) Patent No.: US 10,712,132 B2
(45) Date of Patent: Jul. 14, 2020

(54) TOWED, AUTONOMOUS, OR REMOTELY CONTROLLED AIRBORNE MOBILE SYSTEM INCLUDING A PLURALITY OF REFLECTION STRUCTURE SECTIONS AND SHAPES ADAPTED FOR ATTRACTING ATTENTION OF SEARCH SYSTEMS CONFIGURED FOR SENSING PATTERN RECOGNITION BASED ELECTROMAGNETIC OR VISUAL REFLECTIONS FROM THE STRUCTURES AND SHAPES AND RELATED METHODS

(71) Applicant: The United States of America, as represented by the Secretary of the Navy, Crane, IN (US)

(72) Inventors: Gerald F Miller, Bedford, IN (US); James L Stewart, Bloomington, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 574 days.

(21) Appl. No.: 15/419,224

(22) Filed: Jan. 30, 2017

(65) Prior Publication Data

US 2017/0219319 A1 Aug. 3, 2017

Related U.S. Application Data

(60) Provisional application No. 62/290,661, filed on Feb. 3, 2016.

(51) Int. Cl.

| | |
|---|---|
| ***F41J 2/00*** | (2006.01) |
| ***F41J 9/10*** | (2006.01) |
| ***F41G 7/22*** | (2006.01) |

(52) U.S. Cl.
CPC ..... *F41J 2/00* (2013.01); *F41G 7/224* (2013.01); *F41J 9/10* (2013.01)

(58) Field of Classification Search
None
See application file for complete search history.

(56) References Cited

U.S. PATENT DOCUMENTS

| | | | | |
|---|---|---|---|---|
| 5,092,244 | A * | 3/1992 | Giglia | H01Q 15/20 102/293 |
| 8,049,656 | B2 | 11/2011 | Shani et al. | |
| 8,066,218 | B2 | 11/2011 | Rubin | |
| 8,103,398 | B2 | 1/2012 | Duggan et al. | |
| 8,125,369 | B1 | 2/2012 | Kang et al. | |
| 2007/0102570 | A1* | 5/2007 | Luffman | B64B 1/06 244/30 |
| 2014/0070977 | A1* | 3/2014 | Stocke, Jr. | H01Q 17/00 342/1 |
| 2015/0295646 | A1* | 10/2015 | Clemmensen | H04B 10/118 398/125 |
| 2017/0227662 | A1* | 8/2017 | Jaaskelainen | E21B 47/06 |

* cited by examiner

*Primary Examiner* — Vladimir Magloire
*Assistant Examiner* — Donald H B Braswell
(74) *Attorney, Agent, or Firm* — Naval Surface Warfare Center, Crane Division; Christopher A. Monsey

(57) ABSTRACT

Methods and structures associated with a towed, autonomous, or remotely controlled airborne mobile system including a plurality of reflection structure sections and shapes adapted for attracting attention of search systems configured for sensing pattern recognition based electromagnetic or visual reflections from the structures and shapes and related methods.

29 Claims, 12 Drawing Sheets

TOWED, AUTONOMOUS, OR REMOTELY CONTROLLED AIRBORNE MOBILE SYSTEM INCLUDING A PLURALITY OF REFLECTION STRUCTURE SECTIONS AND SHAPES ADAPTED FOR ATTRACTING ATTENTION OF SEARCH SYSTEMS CONFIGURED FOR SENSING PATTERN RECOGNITION BASED ELECTROMAGNETIC OR VISUAL REFLECTIONS FROM THE STRUCTURES AND SHAPES AND RELATED METHODS

CROSS-REFERENCE TO RELATED APPLICATIONS

The present application claims priority to U.S. Provisional Patent Application Ser. No. 62/290,661, filed Feb. 3, 2016, entitled "TOWED, AUTONOMOUS, OR REMOTELY CONTROLLED AIRBORNE MOBILE SYSTEM INCLUDING A PLURALITY OF REFLECTION STRUCTURE SECTIONS AND SHAPES ADAPTED FOR ATTRACTING ATTENTION OF SEARCH SYSTEMS CONFIGURED FOR SENSING PATTERN RECOGNITION BASED ELECTROMAGNETIC OR VISUAL REFLECTIONS FROM THE STRUCTURES AND SHAPES AND RELATED METHODS," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,343) is assigned to the United States Government and is available for licensing for commercial purposes.

BACKGROUND AND SUMMARY OF THE INVENTION

The present invention relates to systems and methods for attracting attention, altering decision(s), or altering operation(s) of a sensing object(s) or entity/entities operating based on sensing capacities including an inflatable sensor attractive system (ISAS). In particular, exemplary embodiments can be operable for altering movement of an entity performing or associated with sensing such as a fixed structure, a mobile structure or a flying platform. Some embodiments can include a towed system that can be autonomously or remotely controlled. Embodiments can also include an airborne mobile system variant including a plurality of reflection structure sections and shapes adapted for attracting attention of sensor or search systems configured for sensing patterns including pattern recognition based electromagnetic or visual reflections from the structures and shapes. Some applications can include attracting attention of rescue forces or providing navigation objects useable with mobile structures such as aircraft, naval vessels (e.g., surface or submerged), space craft, or ground vehicles. Another embodiment can include radar reflective structures (selective or otherwise), inflatable mobile objects with a tracking system(s), guidance system(s), and various payloads associated with aspects of attractive, operations, or movement altering system(s).

At least some embodiments of the invention can increase effectiveness of acting as ISAS to more advanced guidance or pattern recognition sensor systems, including mobile object with guidance, propulsion, payload, and sensor system that can detect multiple radio frequencies (RF) and distinguish among varying infrared (IR) signatures. Embodiments of the invention can increase the likelihood that a mobile object with guidance, propulsion, payload, and sensor system targets the ISAS by detecting and transmitting a variety of mobile object-specific RFs or other electromagnetic spectrum sensor outputs. Additionally, embodiments of the invention, once inflated, may retain a specific shape and contain certain structures along the ISAS that mimic an IR signature of an object of interest, (e.g. a ship), causing such a mobile object with guidance, propulsion, payload, and sensor system that can distinguish between IR signatures to lock on to the ISAS instead of the mobile object's intended objective or track a particular object such as the ISAS that is deployed for reasons such as requesting rescue.

According to an illustrative embodiment of the present disclosure, an ISAS including radar reflective structures can be tethered to a stern of a ship. Upon detecting a mobile object with guidance, propulsion, payload, and sensor system, the ISAS can be rapidly inflated in a direction away from the ship. Once extended, the radar reflective material takes a shape in which the IR signature mimics that of a ship. The IR signature, in addition to RF emissions from the ISAS, causes the incoming mobile object with guidance, propulsion, payload, and sensor system to target the ISAS and not the ship or structure of interest.

According to a further illustrative embodiment of the present disclosure, the ISAS associated with mobile objects with guidance, propulsion, payload, and sensor system can be tethered to one or more Unmanned Ariel Vehicles (UAVs). This exemplary ISAS may act or operate in the same way as described above; however, in this embodiment, the UAV(s) can maneuver the ISAS a greater distance from the ship or move the ISAS with respect to a specific identified sensing entity such as another particular ship, another UAV, another airborne object, a space object etc. to alter attraction functions or sensor signatures of the ISAS.

In some embodiments, an exemplary ISAS can be detached to provide attractive or remote alternation of movement/operation at a distance from a platform such as a ship. This capacity can provide desired functionality and capability remotely with remote control, independent power, communication, sensor, guidance, and propulsion/movement systems.

Advantages of various embodiments of the invention include providing a capability for ships to attract attention or alter operation of entities sensing the ISAS in various situations. For example, a small boat or a ship in distress that is in a busy shipping lane at night can deploy an exemplary ISAS system which then generates an electronic signature or improved radar cross section (as well as other wavelengths used by sensor systems such as infrared or night vision systems) which then draw large ship attention to avoid a collision or navigation hazard. Various embodiments can be used on fixed sites similar to a mobile lighthouse as well as other types of mobile objects such as ground vehicles or stranded parties on land. It can also be used as a distress communication system that can advise ships that normal navigational protocols, like the rules on smaller ships being required to maneuver to avoid collision or cross the path of much larger ships like supertankers, do not apply. Embodiments of the invention can also be used for other mobile applications such as trucks or land based sites as well as space based applications.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
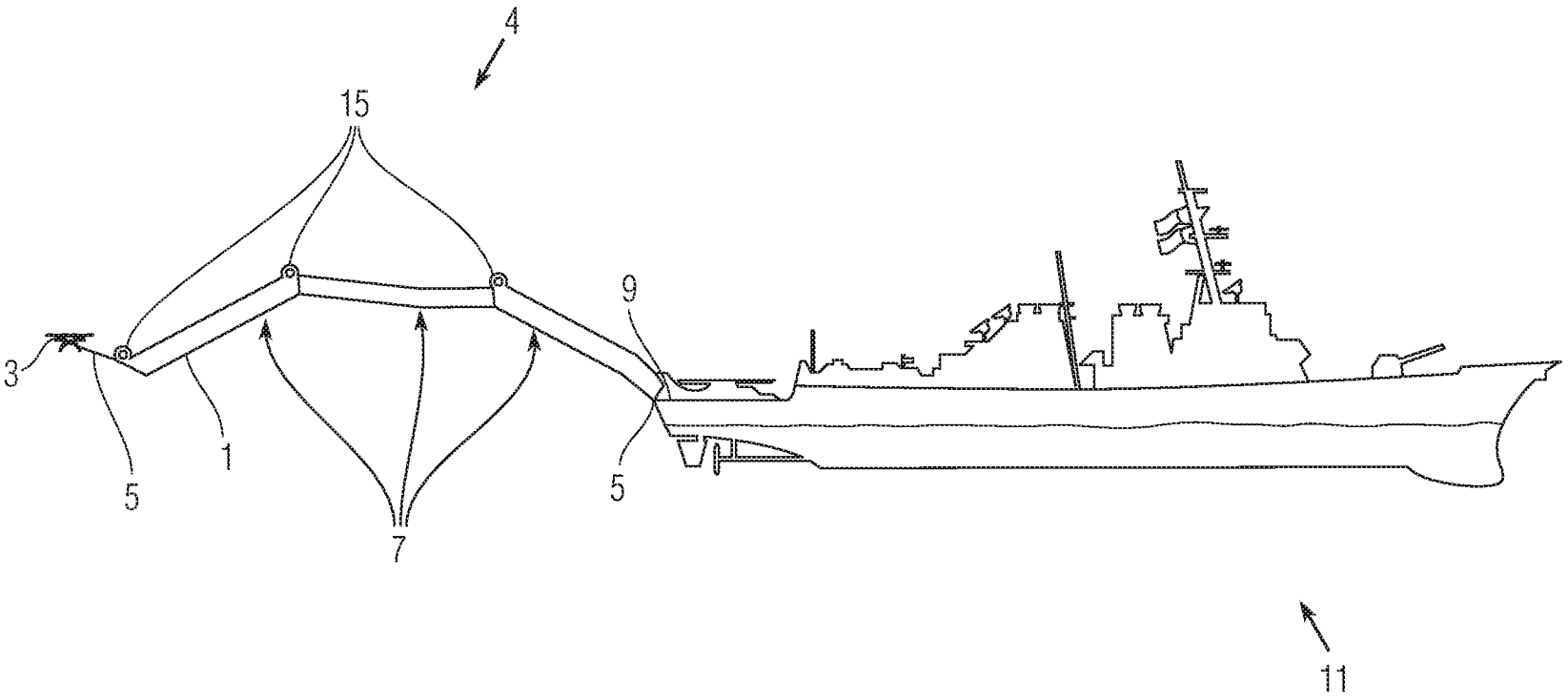
FIG. 1 shows an exemplary embodiment in accordance with this disclosure including a side view of an inflatable sensor attraction system or ISAS tethered to a stern of a ship with at least one UAV tethered to a distal end of the exemplary ISAS.

Referring initially to FIG. 1, an embodiment of an ISAS 4 is shown attached to a platform, in this example a ship 11. The ISAS 4 is attached at one end to the ship 11 via a tether 5. The tether 5 may be fashioned in a manner such that it can detach from either the ship 11 or the ISAS 4, which would allow the ISAS 4 to move in a direction away from the ship 11. The tether 5 can include a fiber optic cable for communicating with and powering the ISAS 4 as well as having a connective cable to provide strength for ensuring the tether 5 does not detach or break prior to a command to detach the ISAS 4. The exemplary fiber optic cable is useful in situations including those where an electromagnetic field generated by a metal power or signal cable is undesirable such as in proximity to scientific testing, communication systems which can be jammed, or other situations where such an electromagnetic field could generate unwanted attention (attracting or altering operation or movement when not desired) or outcomes (e.g., electrostatic discharge in proximity to a fuel leak). A blower 9 is shown coupled to the ship 11. The blower 9 forces hot air into the exemplary ISAS 4, which aids in inflating the ISAS 4, maintaining positive air pressure within the ISAS 4, so that it maintains its shape and maintains its buoyancy relative to the surrounding atmosphere. The blower 9 may contain a valve system (not shown). The valve system can be similar to those used for hot air balloons. The valve system can either remotely or manually control the rate at which air is forced into to the radar reflective structure, (e.g. tube 1).

In one exemplary embodiment, a UAV 3 can be attached at an opposing end of the ISAS 4 from the ship 11 to perform a variety of attractive, operation/movement altering operations including protective operations of a designated ISAS 4 towing platform (e.g., ship). The exemplary UAV 3 is attached to the ISAS 4 via a tether 5. The UAV 3 may be under the control of a remote operator. Alternatively, the ISAS 4 supported or maneuvered by the UAV 3 may have preprogrammed movement or flight information stored; for example, a preprogrammed path or artificial intelligence system with a library of response actions operating based on sensor inputs on the ISAS 4 or the UAV 3 that would maneuver or lead the ISAS 4 in a variety of ways including moving the ISAS 4 to a distance beyond which the ship 11 that can be seen via line of sight. Alternatively, the ISAS 4 UAV 3 can maneuver the ISAS 4 in a path that would stay within a visual range of the point of origin ship but maneuver the ISAS 4 around, (e.g. in an zig-zag manner). The UAV 3, being attached via tether 5, can maneuver the ISAS 4, in a preferred direction, for example, away from the ship 11 in the event the tether 5 connecting the ship 11 and the ISAS 4 is disconnected deliberately or by accident (e.g., emergency clearance maneuvering to avoid collision with the towing ship or another ship or structure in proximity to detach point). ISAS 4 can be detached from the ship 11 or UAV 3 either remotely via remote detach/coupling system that includes actuators and coupling sections or manual coupling/decoupling systems. Embodiments can address protective functions against autonomous vehicle(s), including flying platforms with sensor systems and payloads, which have locked on or are moving towards a platform or location which an operator desires to prevent the autonomous vehicle from interacting with or closing into proximity with. In addition, an exemplary UAV 3 can provide stability and buoyance to the exemplary ISAS 4 so that the ISAS 4 remains in an orientation that allows attractive systems, (e.g. the IR signal of the ISAS 4), to mimic that of the ship 11, causing incoming autonomous vehicles or mobile objects with guidance, propulsion, payload, and sensor system to target the ISAS 4 and not the ship 11.

At least one exemplary ISAS 4 can include a radar reflective tube 1. The radar reflective tube 1 may be inflated manually or automatically by the blower 9 or by a charge or gas generator that produces chemical reactions that create a gas. A plurality of heat emitters 15 can be disposed along the radar reflective tube 1. The heat emitters 15 may be in any number and placed anywhere along the radar reflective tube 1 to create a desired IR signal that creates a desired IR pattern including an IR pattern associated with a specific ship 11 or target that an operator desires to attract attention or move attention away from. As depicted in FIG. 1, the heat emitters 15 are positioned so as to mimic the IR signature of the ship 11. Additionally, one or more flexible foil tuned reflectors 7 may be attached to the radar reflective tube 1. The flexible foil tuned reflectors 7 can include a material, such as aluminum, and are attached extending outward from the radar reflective tube 1. Exemplary flexible foil tuned reflectors 7 are capable of reflecting a predetermined RF and can be adjusted to reflect various RFs by adjusting the width, length, thickness, and shape of the flexible foil tuned reflectors 7.

Figure 2:
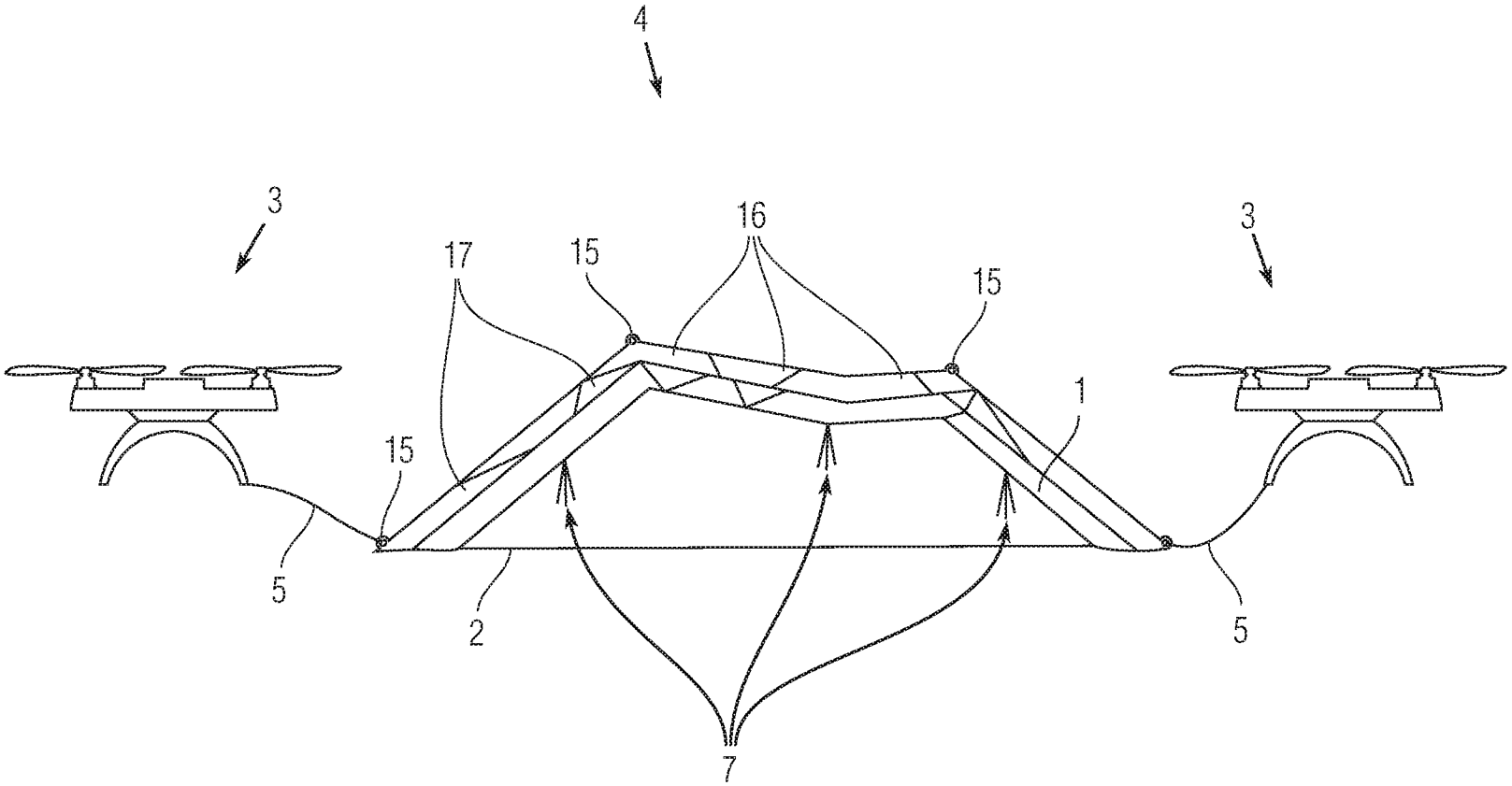
FIG. 2 shows an exemplary side view of a section of the FIG. 1 embodiment including tethers on each end section of the exemplary ISAS by a supported and/or powered airborne UAV.

Referring now to FIG. 2, an embodiment of the ISAS 4 is shown attached to a UAV 3 at both ends of the radar reflective tube 1. In this embodiment, a weighted cable 2 connects both ends of the radar reflective tube 1 in a horizontal plane between the UAVs 3. The weighted cable 2 keeps a uniform spacing between the two UAVs 3 during rapid deployment of the ISAS 4 and free flight. Additionally, the weighted cable 2 causes the ISAS 4 to remain in an orientation that allows the IR signal of the ISAS 4 to mimic that of a desired structure of interest. Disposed along the radar reflective tube 1 are heat emitters 15. The heat emitters 15 may be in any number and placed anywhere along the radar reflective tube 1 to create an IR signal that mimics a structure of interest. Attached along the radar reflective tube 1 are one or more flexible foil tuned reflectors 7 to mimic a predetermined RF signal of a structure of interest. An alternative embodiment of the invention can add another UAV (not shown) to a middle section of the ISAS to provide additional upright stability and posture control or manipulation. Alternatively, the ISAS 4 can also be filled with another or additional type of lighter than air gas such as helium which is filled from gas storage structures (not shown).

Additionally, corner reflectors 17 may be disposed along the radar reflective tube 1. The corner reflectors 17 provide a higher rate of RF signal return. The corner reflectors may be in any number along the radar reflective tube 1 and be comprised of a material capable of reflecting RF; and additionally, the corner reflectors 7 may be in various thicknesses to enhance RF signal return.

Additionally, one or more embodiments of the exemplary inflatable gas bags contained within the inflatable structure may incorporate modular design elements. Some embodiments may have segments or modules having individual inflator systems which inflate only the module or segments having such an inflator system. Alternatively, embodiments may be provided which have a gas or air passage coupling the segments or modules together, (e.g. through a valve or aperture coupling any two segments or modules), so as to permit collective inflation. In some embodiments, a plurality of inflatable segments or modules may be coupled together to inflate and orient the inflatable structure with respect to the operator or system with exemplary sensor. These inflatable segments or modules may be attached to one another using a variety of methods or structures such as cables or other attaching structures. One example can include flaps with an adjustable coupling structure,(e.g. Velcro®), that enable an operator to shape a module or segment so that it is collapsed to some extent (e.g. a square) is partially collapsed to form an angled side such as a triangular shape, that permits two groups of segments or modules to connect together at an angle with respect to each other (e.g. such as forming a V shaped structure with the collapsed segments or modules forming two triangular shaped sections allowing for the base or connective junction of the V shape to be formed that collapse) compressing the inflatable gas structure, (e.g. inflatable gas bag), and allowing the segments or modules to inflate with a desired modified shape. Another exemplary embodiment can include creation of adjustable or selective coupling sections such as, providing an overlapping flap on one inflatable segment or module that extends so it can be hooked or coupled with a corresponding coupling structure in another structure in an adjacent module or section (e.g. into a groove of a second inflatable segment or module), creating a sealing or coupling mechanism between the flap and corresponding coupling structure. In some embodiments, these coupling sections can form an airtight seal so that both segments can be inflated by passing air or gas through one into another. Some embodiments might include an exemplary structure or system which permits a selective coupling side of a segment or module to decouple from three edges of the segment or module and then extend laterally from an uncoupled edge of the selective coupling side that then couples with an adjacent segment or module which also has an identical or similar selective coupling side which then is decoupled from its respective module or segment and then coupled with its corresponding adjacent module or segment. Sealing structures (e.g., ziplock or press seal structures) can be provided on edges of both inflatable structures which provide a pressure seal for at least two edges of each two adjacent segments or modules facing each other.

Additionally, one or more inflatable gas bags contained within the inflatable structure, may work in a modular fashion, with each segment containing its own inflator. A plurality of inflatable segments may be coupled together to inflate and orient the inflatable structure with respect to the operator or system with the sensor. These inflatable segments may be attached to one another using a variety of methods. One example includes Velcro® flaps that collapse, compressing the inflatable bag, and allowing the segments to inflate. Another example includes the creation of junctions, in which an overlapping flap on one inflatable segment can be hooked into a groove of a second inflatable segment, creating a sealing mechanism between the male and female securements.

Figure 3:
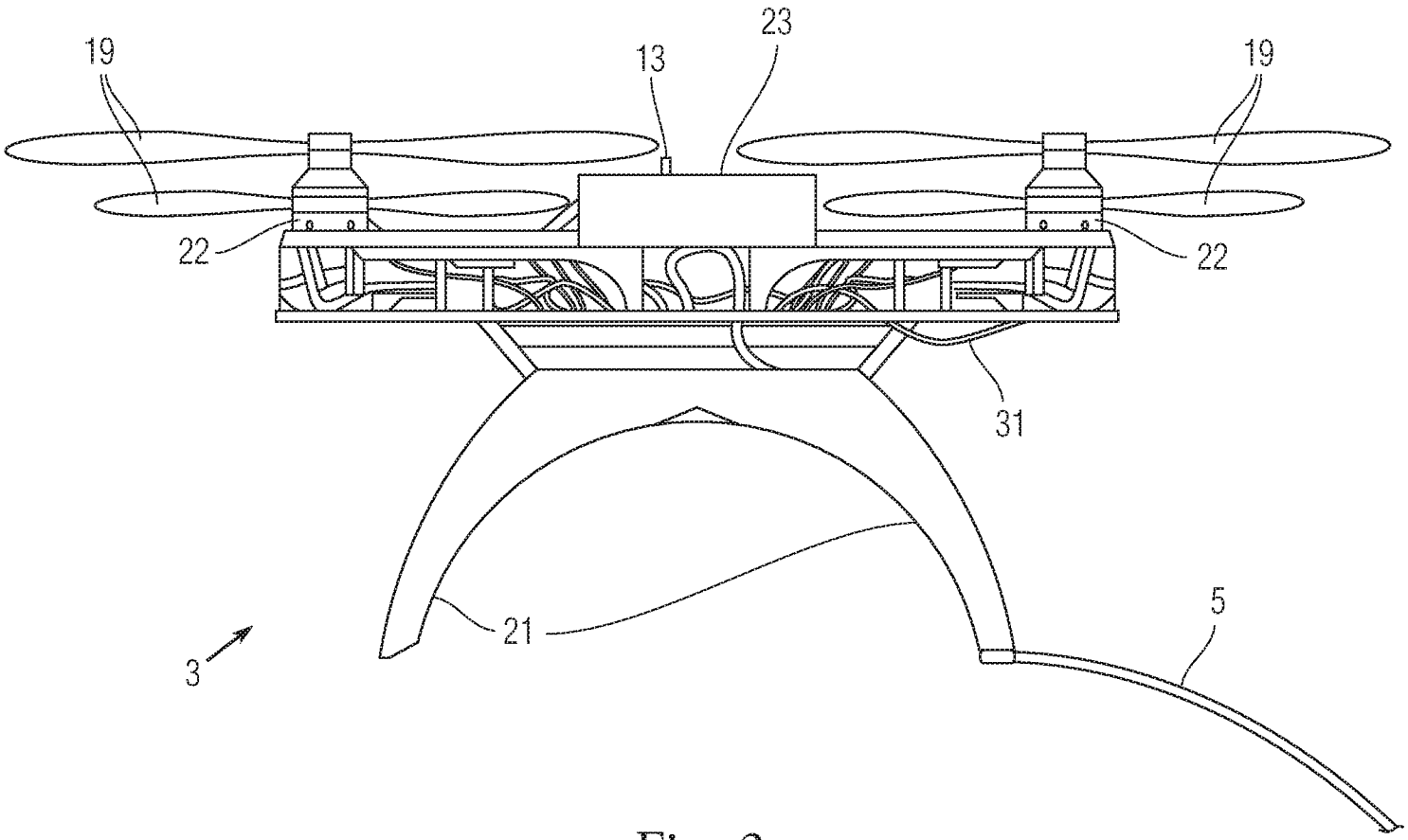
FIG. 3 shows an exemplary longitudinal view and partial cross section of the exemplary FIG. 1 or 2 ISAS with tethered UAV.

Referring now to FIG. 3, which depicts one example of a UAV 3. The exemplary embodiment shown in FIG. 3 is a gyroscope. A plurality of propellers 19 provides the lift necessary for the UAV 3 to maintain flight and maneuver a load attached to a tether 5. The UAV 3 contains an auxiliary power source 23 that provides power to one or more electric motors 22. The power source 23 may be, for example, an electric battery or an engine that burns liquid fuel, such as JP8. The electric motors 22 are coupled to the propellers 19. Landing gear 21 attached to the UAV 3 may stabilize the UAV 3 while stationary on the ground or during flight.

In at least some embodiments, various factors may individually or collectively affect RCS, including size, material, shape, incident angle, and reflected angle. Higher RCS indicates higher reflectivity, indicating that an object is more easily detectible. Exemplary ISAS 4 can be formed or operated to present a specific RCS associated with a specific object of interest (e.g., a particular type of ship RCS or other structure of interest), controlled by the PMACC.

Figure 4:
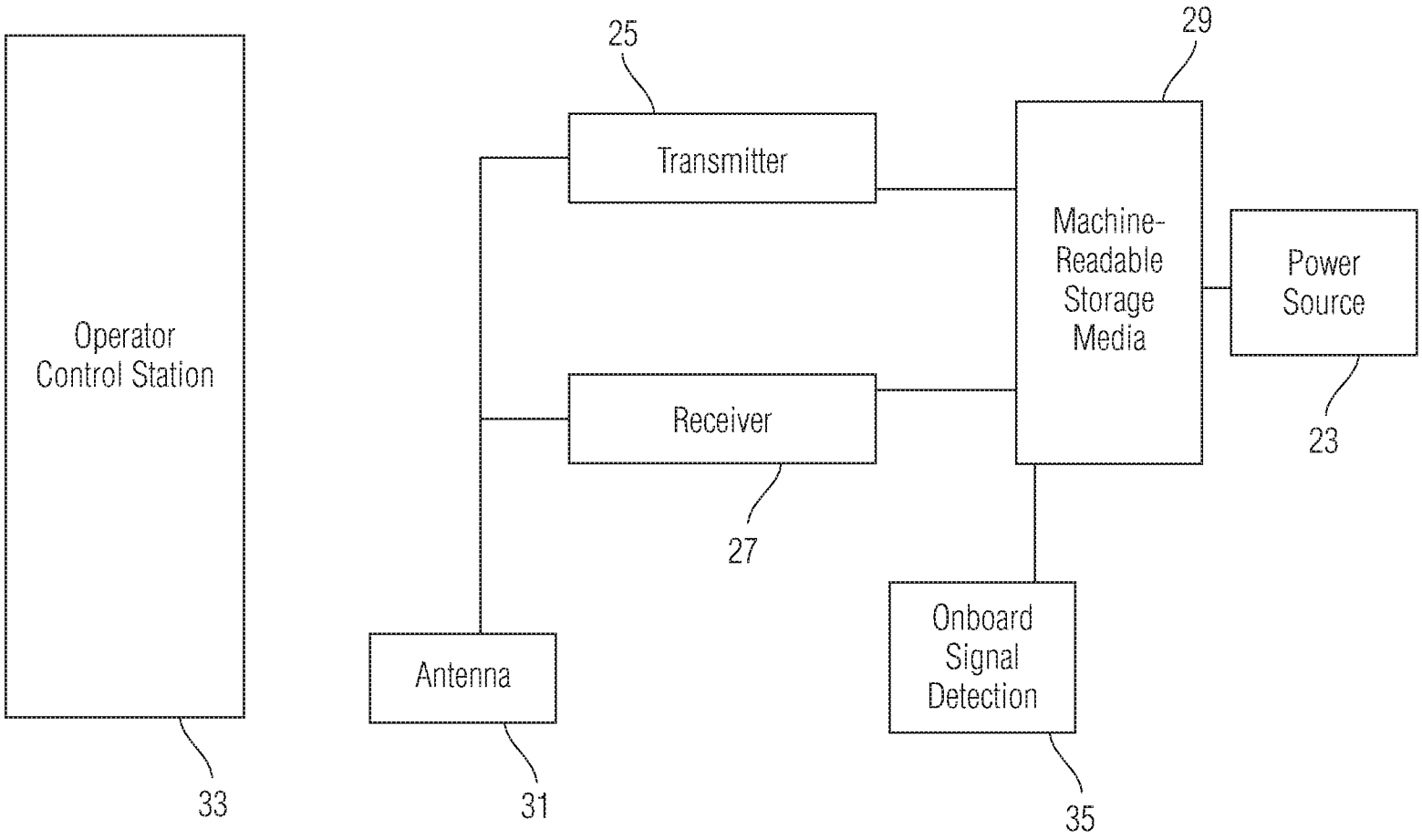
FIG. 4 shows a block diagram of an exemplary control system associated with an embodiment of the disclosure.
Figure 7:
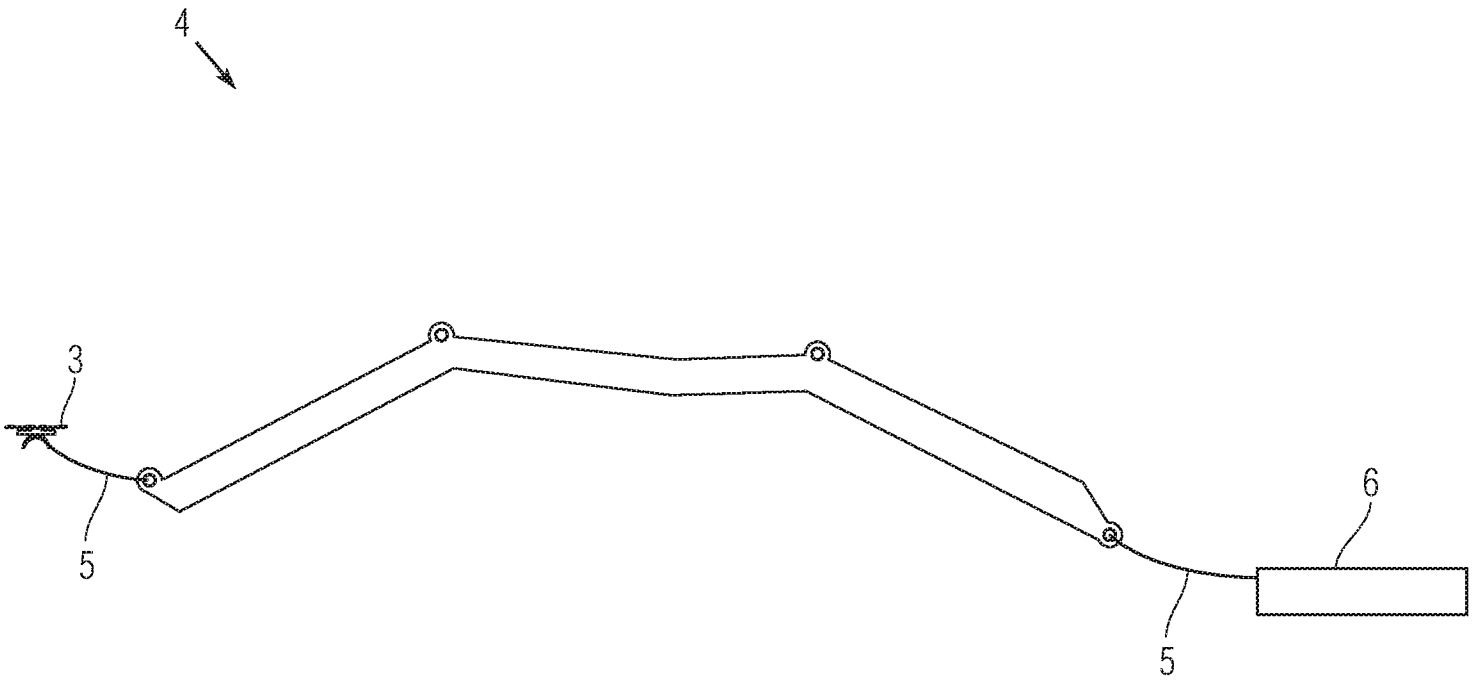
FIG. 7 shows a side view of an exemplary embodiment of the ISAS tethered to an unmanned watercraft.

Referring now to FIG. 4, which shows a simplified functional block diagram to represent at least some functionality of UAV 3 or unmanned watercraft 6 including at least some on-board systems. The UAV 3 or unmanned watercraft 6 (as shown in FIG. 7) includes a power source 23 that provides power to a receiver 27, a transmitter 25, and a machine-readable storage media 29 (e.g., data storage device such as a hard drive) that can include control software or other control systems (not shown) such as a controller, processor, etc., for operating the UAV 3 or unmanned watercraft 6 and its on board systems. Exemplary systems which might be adapted for in combination with other aspects of this disclosure can include systems or architecture shown in U.S. Pat. No. 8,103,398, Unmanned Aerial Vehicle Control Systems, which is incorporated by reference herein. Receiver 27 can receive commands or control inputs wirelessly from an operator control station 33. An RF transmitter 25 in conjunction with antenna 31 may emit one or more RF signals. The machine-readable storage media 29 can receive and store dynamically sent or preprogrammed flight information. In this exemplary embodiment, both the UAV 3 and the unmanned watercraft 6 may include onboard signal detection and processing system 35. The onboard signal detection and processing system 35 has onboard control logic or software subroutines that are configured to detect electromagnetic signals, (e.g. RF signals), from a mobile object of interest, such as an incoming mobile object or vehicle with guidance, propulsion, payload, and sensor system or other entities such as a rescue or first responder team. The onboard signal detection and processing system 35 can determine a location and movement path of the mobile object or vehicle as well as identify types of mobile objects or vehicles such as an airborne autonomous vehicle, a flying system, a ship, etc. The onboard signal detection and processing system 35 can include on board analysis systems, such as a pattern recognition system and a response library with a rule base and engine which matches the electromagnetic signals with entity entries in the library which in turn provides signal analysis or sensor data to the user or is used to control the UAV 3 to maneuver the ISAS 4. The UAV 3 or the unmanned watercraft 6 can respond to information received and processed by the onboard signal detections and processing system 35 by maneuvering the ISAS 4 to an orientation that generates reflective IR signals relative to the incoming mobile object or mobile object or entity of interest which is the object of an attractive or movement/operation alteration activity. An embodiment of this invention can include a control system variant which includes portable maneuver and control cards (PMACC) which each have a memory storage section that stores specific maneuver and operation instructions or control inputs for the UAV 3 to maneuver and operate the ISAS 4. Each PMACC holds different types of pre-programmed maneuver and onboard operating instructions that are labelled with identifiers that signify categories of UAV 3/ISAS 4 responses or operations. An UAV/ISAS operator will receive information on conditions or desired UAV/ISAS operations or effects and will select a PMACC that can address or achieve/perform the conditions or desired UAV/ISAS operations, plug the PMACC into an input port on the UAV 3 connected to onboard control systems, then launch the UAV/ISAS which then is operated at least in part by the PMACC. Use of PMACCs can permit rapid selection of desired operations of the UAV/ISAS. An operator can also be told remotely which PMACCs to select from a remote command and control element such as a control post then insert a selected or correlated PMACC into the UAV/ISAS system for rapid deployment. PMACC memory or storage section can include a machine readable instructions such as software or can be a programmable logic section which can be employed immediately or receive remote inputs from the remote command and control element which then reconfigures programmable logic blocks in the programmable logic section. In some embodiments, each card can have a designator symbol or design on an outer surface which assists in rapid selection of a particular maneuver or control input associated with specific operations the UAV 3/ISAS 4 system will execute. For example, a PMACC can direct an exemplary UAV 3/ISAS 4 to execute a specific maneuver and operate onboard systems or emitters with towards or with respect to a specific source of signals (e.g., a mobile system with a radar system or tracking system such as a ship, vehicle, aircraft, etc.) detecting reflections/emissions from the UAV 3/ISAS 4. This exemplary PMACC maneuvers and operations of onboard systems are selected in order to maximize detection by the source of signals and reflect/generate a specific or predetermined reflection or sensor detection profile back to the source of signals which the source of signals will associated with a specific electromagnetic signal reflection/source profile (e.g., a specific ship type or reflection/emission profile). For example, a maneuver may be to position the ISAS 4 with a specific orientation, (e.g. perpendicular), to a path of travel or radar or tracking system emissions from the specific source of signals so as to present a predetermined radar cross section (RCS) profile of the ISAS 4 to the specific source of signals which matches a profile that the specific source of signals will recognize and be attracted to. Various factors affect the RCS, including size, material, shape, incident angle, and reflected angle. Higher RCS indicates higher reflectivity, indicating that an object is more easily detectible. The ISAS 4 can be utilized to present a specific RCS, controlled by the PMACC. The exemplary PMACC can also operate on board systems such as various emitters including electromagnetic spectrum (EMS) emitters.

Figure 5:
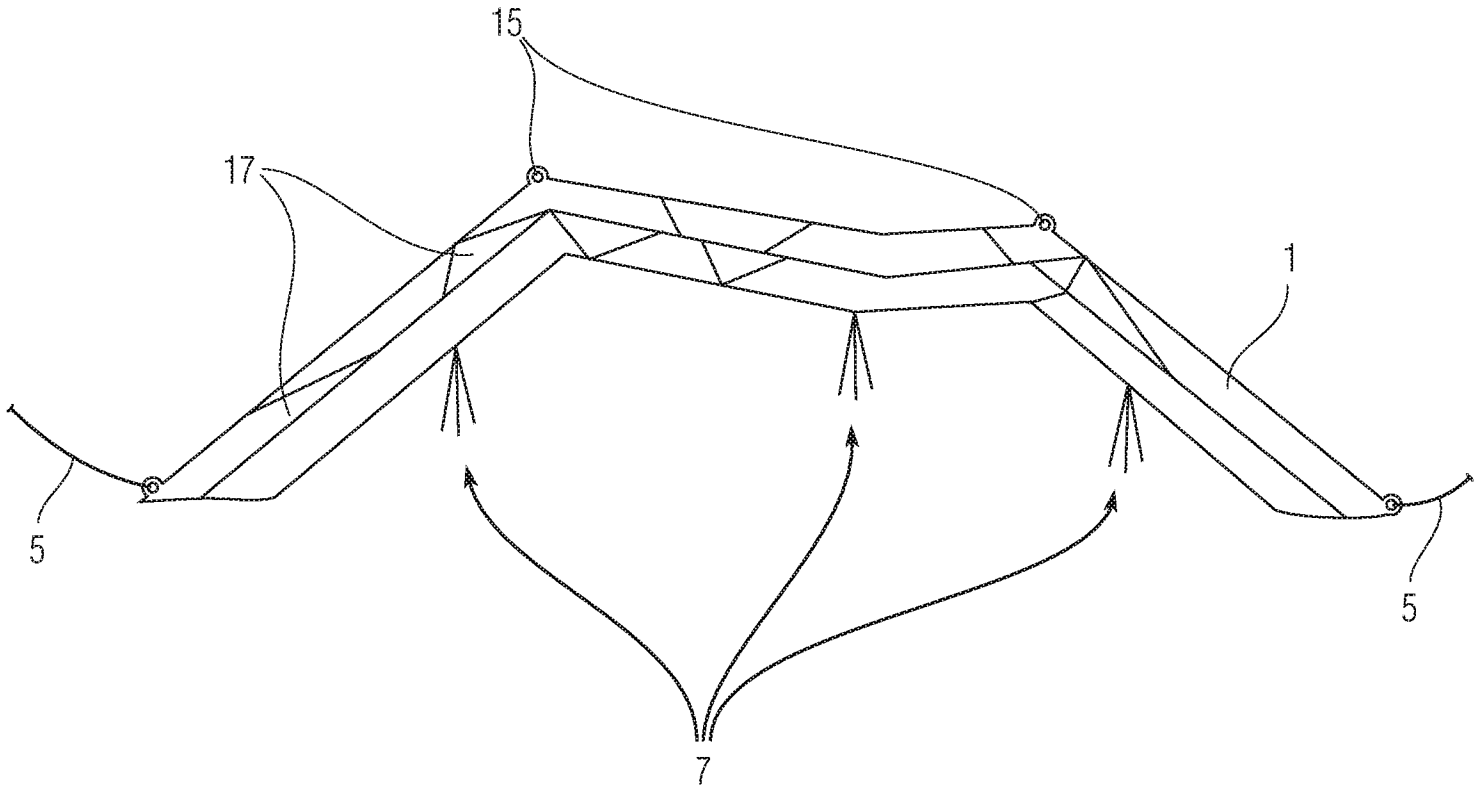
FIG. 5 shows a side view of an embodiment of an exemplary ISAS.

Referring now to FIG. 5, another embodiment of the ISAS 4 is shown. The exemplary ISAS 4 shown includes a tether 5 on each end. The tether 5 attaches to a mobile object that is capable of maneuvering the ISAS 4, such as an unmanned watercraft, a UAV, a manned vessel, a manned aircraft, etc. The ISAS 4 shown comprises a radar reflective tube 1 containing a number of corner reflector 17 sections disposed along both sides for reflecting an IR signal that at least partially matches emissive characteristics of another structure such as a particular ship or mobile object or entity of interest. The corner reflector 17 sections may be formed from various elemental metals, elemental metalloids, or metal alloys. Additionally, one or more pluralities of heat emitters 15 are disposed along the radar reflective tube 1. The heat emitters 15 generate a greater IR signal than a surrounding material and can be placed anywhere along the radar reflective tube 1 in order to mimic cross-sectional IR signature aspects of a vehicle or an object of interest, such as a ship. Additionally, flexible foil tuned reflectors 7 may be placed anywhere along the radar reflective tube 1 to create a predetermined or desired reflective IR signal of the vehicle or object of interest.

Figure 6:
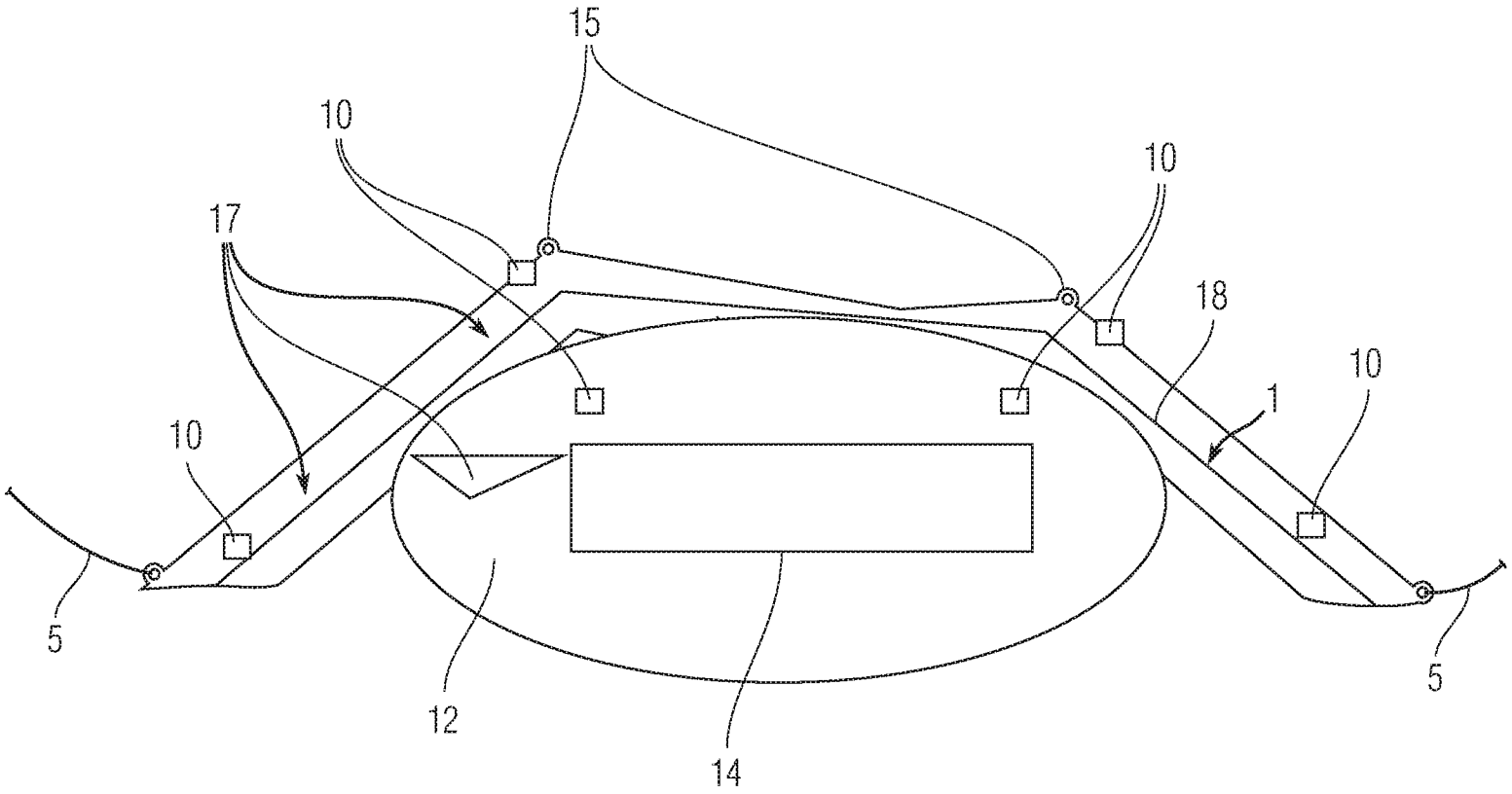
FIG. 6 shows a side view of an embodiment of an exemplary ISAS having an attached curtain.

FIG. 6 shows an additional embodiment of the ISAS 4. In this embodiment, the radar reflective tube 1 may also have visual EMS emitters 10. The visual EMS emitters 10 emit electromagnetic radiation of various wavelengths that can be detected by the human eye. The visual EMS emitters 10 may be in any number and placed in any number along the radar reflective tube 1, in any pattern. Preferentially, the pattern should have a similar appearance of an object of interest from a distance. An additional feature of this embodiment may include a hanging curtain 12 that runs along a rope and pulley system 18 disposed along the radar reflective tube 1. The rope and pulley system 18 can be used to deploy the curtain 12 as the ISAS 4 is deployed. The curtain 12 may contain additional corner reflector 17 sections, visual EMS emitters 10, and an image 14, all working in conjunction to create the desired reflective IR signal and desired visual image that mimics an exemplary vehicle or object of interest. The visual image displayed by the curtain 12 may directly printed onto the curtain prior to deployment; while alternatively, the image may be projected onto the curtain using a projector capable of emitting visual light in a desired pattern.

FIG. 7 shows an alternative embodiment of the ISAS 4. In this embodiment, the ISAS 4 has a tether 5 at one end connected to a UAV 3. On the other end, the ISAS 4 has another tether 5 connected to an unmanned watercraft 6. The unmanned watercraft 6 may be manually controlled remotely or it may have preprogrammed guidance information.

Figure 8:
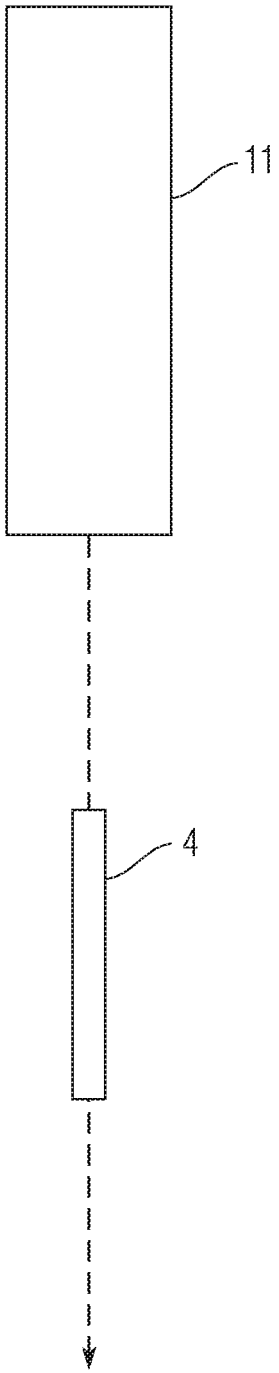
FIG. 8 shows a top view of a ship or platform after deploying the ISAS as the ISAS moves away from the ship.

FIG. 8 depicts an exemplary ISAS 4 as it deploys from a platform, e.g., ship 11. This embodiment can be described, for example, as an antipiracy system. In this manner the ISAS 4 is deployed from the ship 11 and then maneuvered away from the ship beyond the horizon so that the ship cannot be seen from the area in which the ISAS 4 is positioned. In this embodiment, over-the-horizon (OTH) communications methods, such as satellite communication, may be needed for the ship 11 to communication with the UAV 3 or the unmanned watercraft 6 towing the ISAS 4. In this way, pirates can be attracted away from the ship and protected from the pirates. The ISAS 4 in this embodiment can include a self-destruct system or scuttling system which can totally or partially destruct the ISAS 4 or sink it. Some embodiments can include additional features such as a rapid movement feature so that if the pirates or entities of interest seek to capture the ISAS 4, the ISAS 4 can deploy these rapid movement features which could include an additional gas generator that generates additional lift such as via a balloon, a paraglider, etc. which is towed by the exemplary UAV 3 above the water out of reach of the entities of interest or pirates. Another embodiment enables the UAV 3 to detach from a portion of the ISAS 4 and sinks the remaining portion of the ISAS or otherwise renders the remaining portion inaccessible to the entities of interest or pirates, etc. while permitting the UAS 3 to return to a designated location such as the ship that launched the ISAS 4. The rapid movement system can also include weights which are dropped which permit the ISAS 4 to float or increase in altitude to become inaccessible to the entity of interest or pirates etc.

Figure 9:
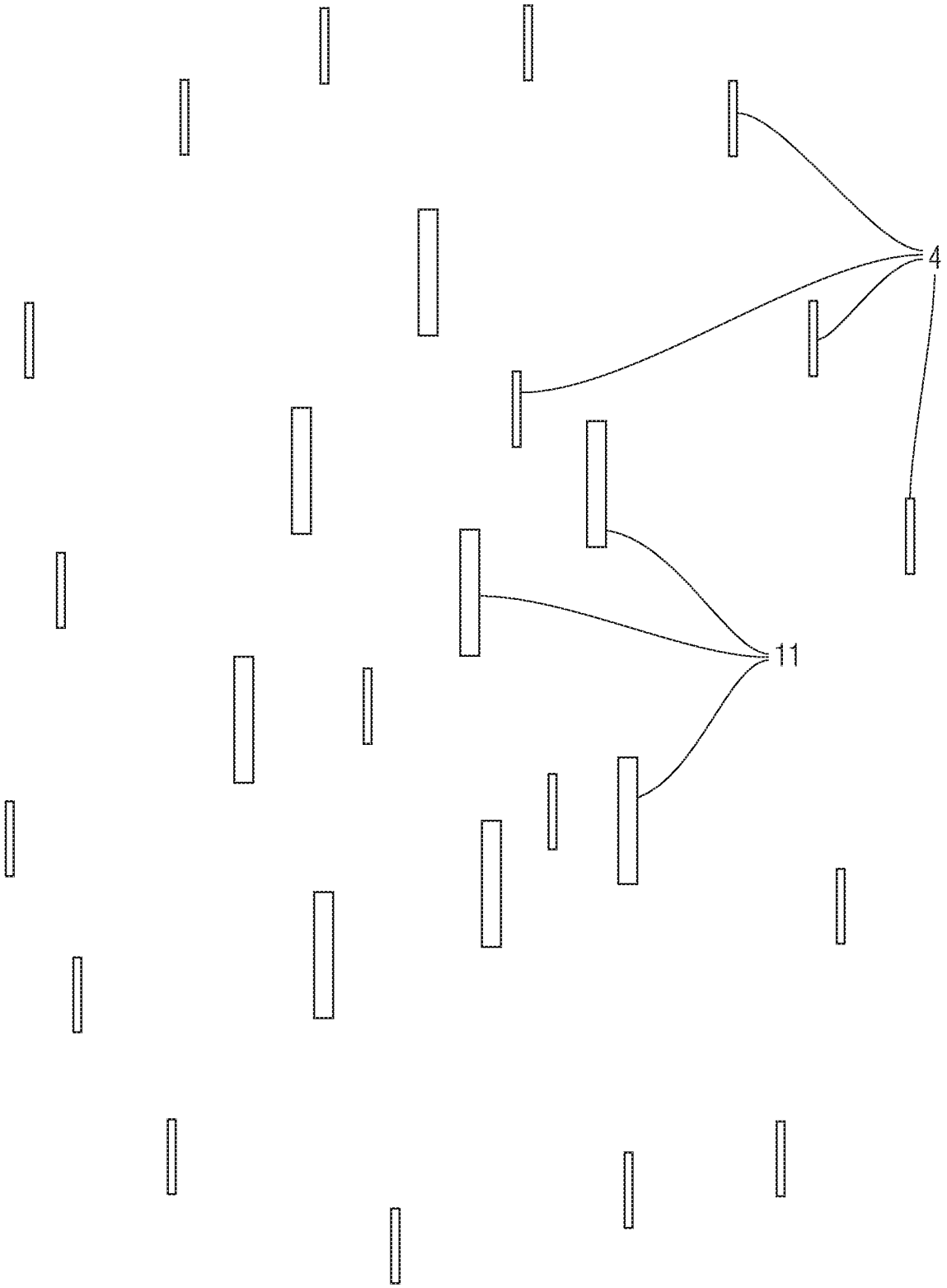
FIG. 9 shows an exemplary top view of a plurality of ships and a plurality of ISASs.

FIG. 9 shows a plurality of ships 11 and a plurality of ISASs 4. As shown, the ISASs 4 act to assist the ships, (e.g. protect the ships 11), from an incoming mobile object (e.g., airborne vehicle, pirates, etc.) with guidance, propulsion, payload, and sensor system (not shown) which maneuver and operate the ISAS 4 system to draw or attract incoming mobile objects or other entities. Additionally, from a distance, the plurality of ISASs 4 may cause detection systems and humans relying on sight to believe there are more ships 11 than are actually present which might attract or deter detections systems or humans with respect to the protected ships.

Figure 10:
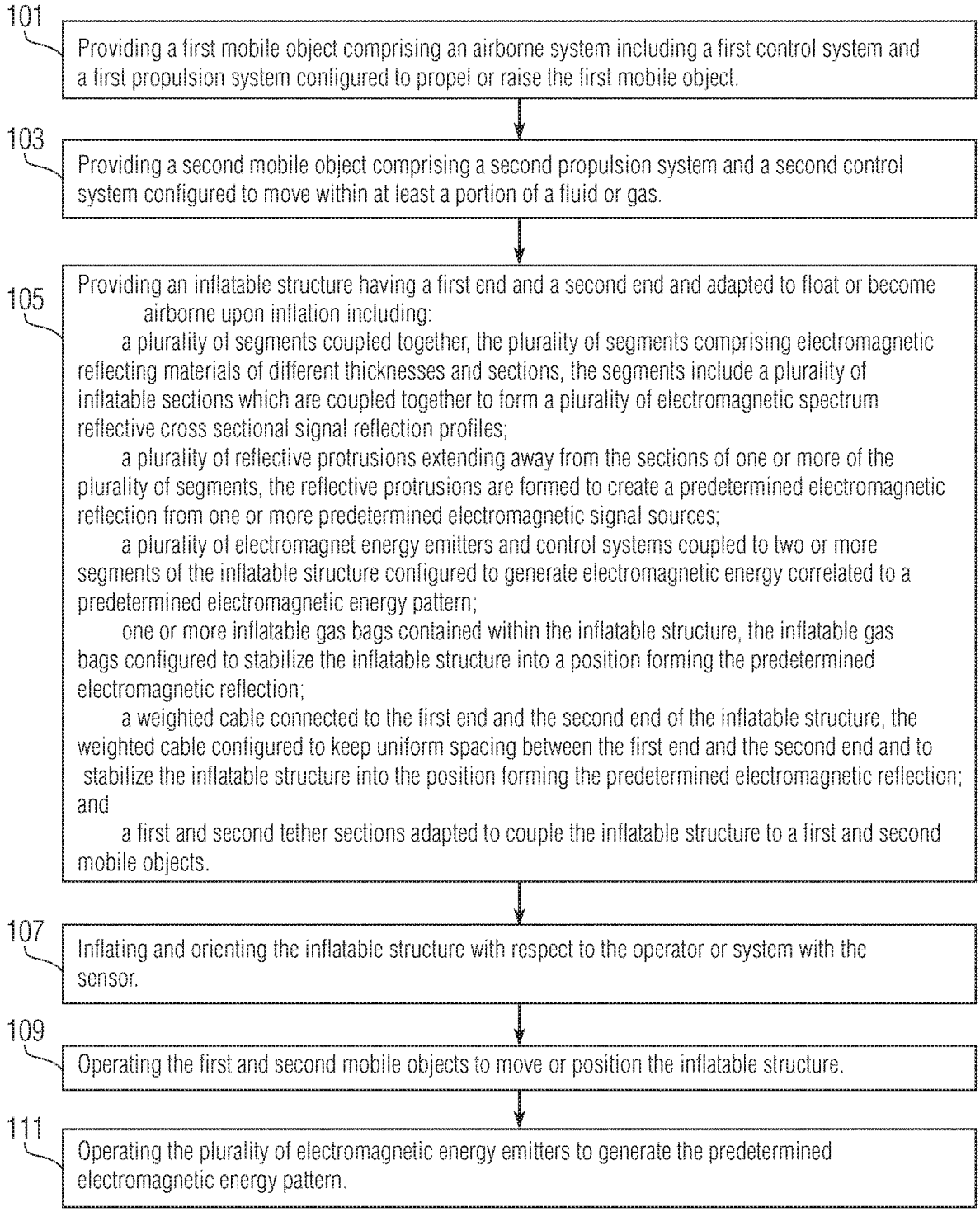
FIG. 10 shows an exemplary method in accordance with one embodiment of the invention.

Various methods can be used with various embodiments of the invention. Referring to FIG. 10, a method associated with operating a system configured for attracting attention or focus of an operator or system with at least one sensor is shown. At step 101: providing a first mobile object comprising an airborne system including a first control system and a first propulsion system configured to propel or raise the first mobile object; at step 103: providing a second mobile object comprising a second propulsion system and a second control system configured to move within at least a portion of a fluid or gas; and at step 105: providing an inflatable structure having a first end and a second end and adapted to float or become airborne upon inflation including: a plurality of segments coupled together, the plurality of segments including electromagnetic reflecting materials of different thicknesses and sections, the segments include a plurality of inflatable sections which are coupled together to form a plurality of electromagnetic spectrum reflective cross sectional signal reflection profiles;

a plurality of reflective protrusions extending away from sections of one or more of the plurality of segments, the reflective protrusions are formed to create a predetermined electromagnetic reflection from one or more predetermined electromagnetic signal sources; a plurality of electromagnetic energy emitters and control systems coupled to two or more segments of the inflatable structure configured to generate electromagnetic energy correlated to a predetermined electromagnetic energy pattern; one or more inflatable gas bags contained within the inflatable structure, the inflatable gas bags configured to stabilize the inflatable structure into a position forming the predetermined electromagnetic reflection; a weighted cable connected to the first end and the second end of the inflatable structure, the weighted cable configured to keep uniform spacing between the first end and the second end and to stabilize the inflatable structure into the position forming the predetermined electromagnetic reflection; and a first and second tether sections adapted to couple the inflatable structure to a first and a second mobile objects. At step 107: inflating and orienting the inflatable structure with respect to the operator or system with the sensor; at step 109: operating the first and second mobile objects to move or position the inflatable structure; and at step 111: operating the plurality of electromagnetic energy emitters to generate the predetermined electromagnetic energy pattern.

Figure 11:
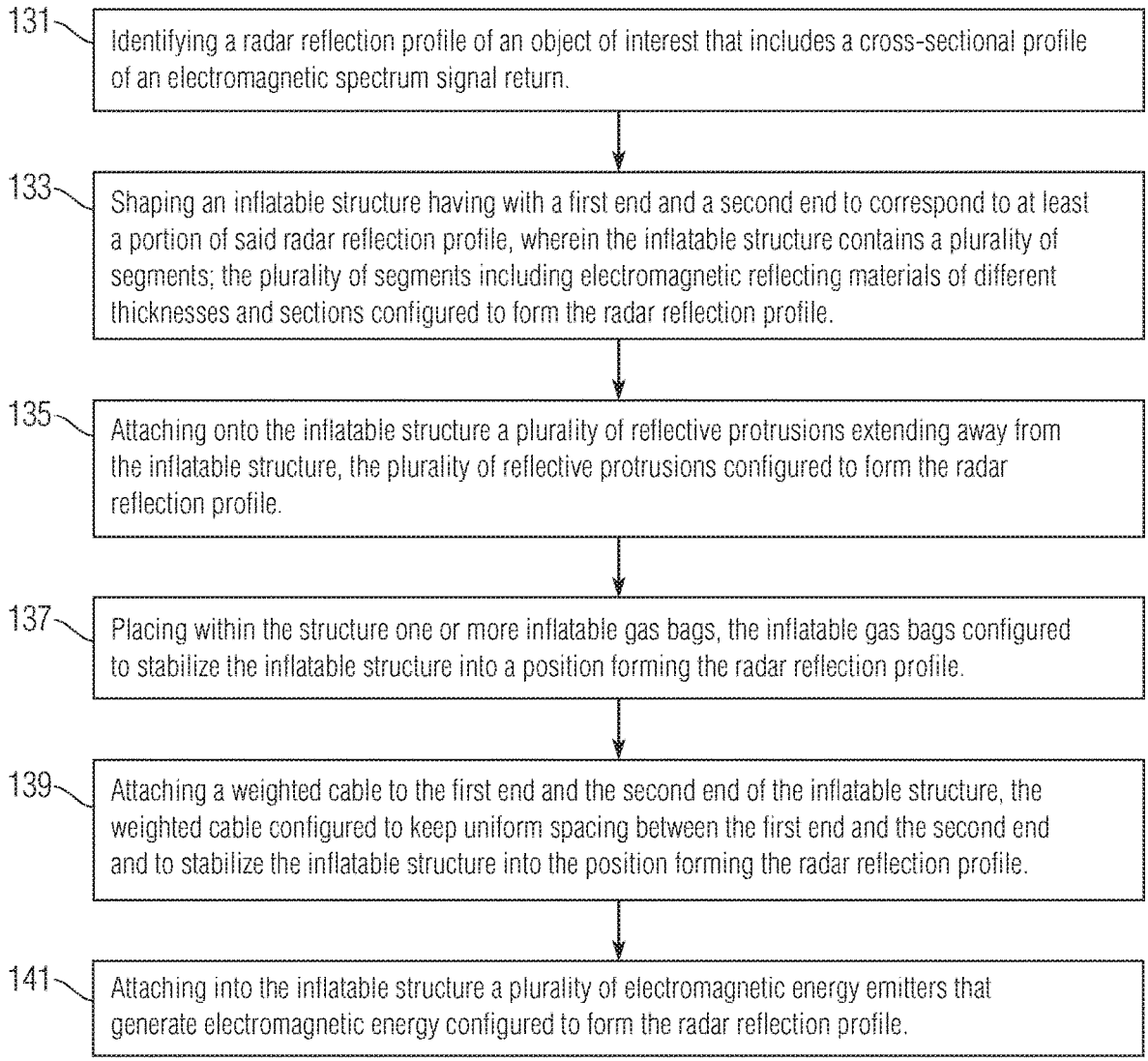
FIG. 11 shows another exemplary method in accordance with one embodiment of the invention.

Referring to FIG. 11, a method of designing and manufacturing a system configured for attracting attention or focus of an operator or system with a sensor is shown. At step 131: identifying an electromagnetic signal reflection profile (e.g., radar reflection profile) of an object of interest that includes a radar or electromagnetic signal cross-sectional profile of a radar return with respect to one or more receivers or electromagnetic spectrum signal sources (optionally including orientation with respect to a transmission or reception axis relative to the electromagnetic signal source or sources). At step 133: shaping or forming an inflatable structure having with a first end and a second end to correspond to or contribute to creating at least a portion of said electromagnetic signal reflection profile, wherein the inflatable structure contains a plurality of segments; the plurality of segments including electromagnetic reflecting materials of different thicknesses and sections configured to form or contribute to generating the electromagnetic signal reflection profile. At step 135: attaching a plurality of reflective protrusions onto the inflatable structure extending away from the inflatable structure, the plurality of reflective protrusions configured to form at least part of the electromagnetic signal reflection profile. At step 137: placing or disposing within or as a part of the inflatable structure one or more inflatable gas bags or containing structures, the inflatable gas bags or containing structures configured to stabilize or orient the inflatable structure into a position contributing to creating or producing the radar reflection profile. At step 139: attaching a weighted cable to the first end and the second end of the inflatable structure, the weighted cable configured to keep uniform spacing between the first end and the second end and to stabilize the inflatable structure into the position forming the radar reflection profile. At step 141: attaching a plurality of electromagnetic energy emitters onto the inflatable structure that generate electromagnetic energy configured to form the radar reflection profile.

Figure 12:
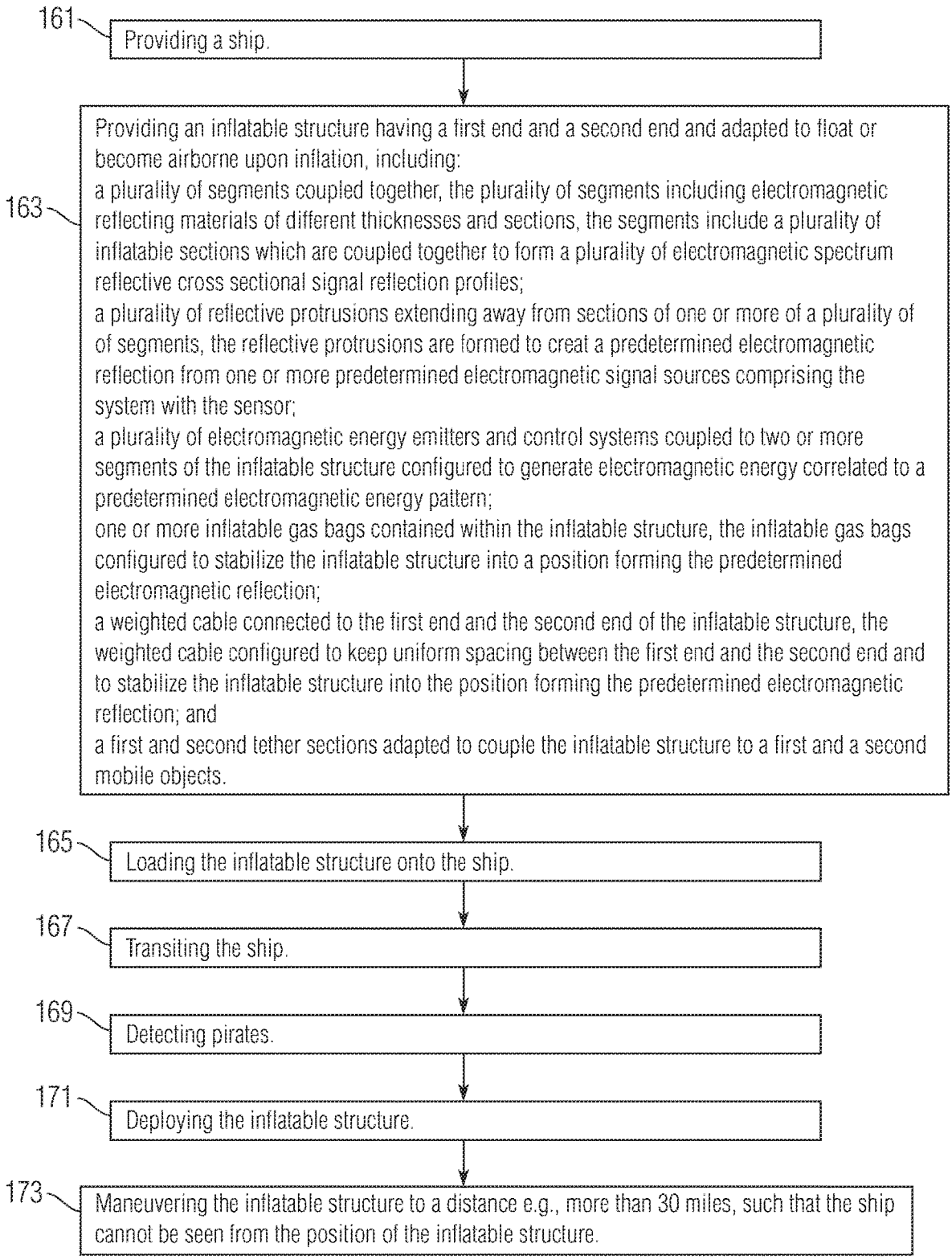
FIG. 12 shows an exemplary method in accordance with one embodiment of the invention.

Referring to FIG. 12, an exemplary method for attracting pirates is shown. At step 161: providing a ship; at step 163: providing an inflatable structure having a first end and a second end and adapted to float or become airborne upon inflation, including a plurality of segments coupled together, the plurality of segments including electromagnetic reflecting materials of different thicknesses and sections, the segments include a plurality of inflatable sections which are coupled together to form a plurality of electromagnetic spectrum reflective cross sectional signal reflection profiles; a plurality of reflective protrusions extending away from sections of one or more of a plurality of segments, the reflective protrusions are formed to create a predetermined electromagnetic reflection from one or more predetermined electromagnetic signal sources comprising the system with the sensor; a plurality of electromagnetic energy emitters and control systems coupled to two or more segments of the inflatable structure configured to generate electromagnetic energy correlated to a predetermined electromagnetic energy pattern; one or more inflatable gas bags contained within the inflatable structure, the inflatable gas bags configured to stabilize the inflatable structure into a position forming the predetermined electromagnetic reflection; a weighted cable connected to the first end and the second end of the inflatable structure, the weighted cable configured to keep uniform spacing between the first end and the second end and to stabilize the inflatable structure into the position forming the predetermined electromagnetic reflection; and a first and second tether sections adapted to couple the inflatable structure to a first and a second mobile objects; at step 165: loading onto the ship the inflatable structure; at step 167: transiting the ship; at step 169: detecting pirates; at step 171: deploying the inflatable structure; and at step 173: Maneuvering the inflatable structure to a distance, e.g., more than 30 miles, such that the ship cannot be seen from the position of the inflatable structure.

Although the invention has been described in detail with reference to certain preferred embodiments, variations and modifications exist within the spirit and scope of the invention as described and defined in the following claims.

The invention claimed is:

1. A system configured for attracting attention or focus of an operator or system with a sensor comprising:

a first mobile object comprising an airborne system including a first control system and a first propulsion system configured to propel or raise the first mobile object;

a second mobile object comprising a second propulsion system and a second control system configured to move within at least a portion of a fluid or gas; and an inflatable structure having a first end and a second end and adapted to float or become airborne upon inflation comprising:

a plurality of segments coupled together, said plurality of segments comprising electromagnetic reflecting materials of different thicknesses and sections, said plurality of segments include a plurality of inflatable sections which are coupled together to form a plurality of electromagnetic spectrum reflective cross sectional signal reflection profiles formed to create a first plurality of predetermined electromagnetic reflections from one or more predetermined electromagnetic signal sources;

a plurality of reflective protrusions extending away from sections of one or more said plurality of segments, said plurality of reflective protrusions are formed to create a second plurality of predetermined electromagnetic reflections from said one or more predetermined electromagnetic signal sources;

a plurality of electromagnetic energy emitters and control systems coupled to two or more said plurality of segments of said inflatable structure configured to generate electromagnetic energy correlated to a predetermined electromagnetic energy pattern associated with at least one infrared and visual spectrum signatures associated with an object of interest;

one or more inflatable gas bags contained within said inflatable structure, said inflatable gas bags configured to stabilize said inflatable structure into a position that contributes to generating said first plurality of predetermined electromagnetic reflections;

a weighted cable connected to said first end and said second end of said inflatable structure, said weighted cable configured to keep uniform spacing between said first end and said second end and to stabilize said inflatable structure into said position forming at least said first plurality of predetermined electromagnetic reflections;

a first and second tether sections adapted to couple said inflatable structure to said first mobile object and said second mobile objects; and a blower coupled to the second mobile object configured to force a heated buoyancy gas into the inflatable structure wherein the blower provides heated gas into said inflatable structure so as to provide heated lighter than air gas into the inflatable structure so that the inflatable structure, once inflated, has a specific shape along the inflatable structure associated with at least a portion of the infrared spectrum signature of the object of interest;

wherein the inflatable structure comprises helium gas storage sections in addition to another type of gas.

2. The system of claim 1, wherein said tether sections couple with a fiber optic cable configured to receive transmissions from and communicate with the inflatable structure.

3. The system of claim 2, wherein said inflatable structure is powered by the fiber optic cable.

4. The system of claim 1, wherein said tether sections couple with a connective cable configured to provide strength so that the tether does not break or detach.

5. The system of claim 1, wherein said buoyancy gas comprises heated air or a lighter than air gas.

6. The system of claim 1, further comprising a first platform, said inflatable structure is selectively and detachably disposed on a portion of said first platform.

7. The system of claim 6, wherein said first platform comprises a ship hull and a deck.

8. The system of claim 1, wherein said first and second mobile objects each comprises an unmanned aerial vehicle, wherein the control system further comprises a communication system that communicates with an operator control station to receive instructions on maneuvering the inflatable structure with respect to the one or more predetermined electromagnetic signal sources that contributes to generating said first and second pluralities of predetermined electromagnetic reflections.

9. A method associated with operating a system configured for attracting attention or focus of an operator or system with a sensor comprising:

providing a first mobile object comprising an airborne system including a first control system and a first propulsion system configured to propel or raise the first mobile object;

providing a second mobile object comprising a second propulsion system and a second control system configured to move within at least a portion of a fluid or gas; and providing an inflatable structure having a first end and a second end and adapted to float or become airborne upon inflation comprising:

a plurality of segments coupled together, said plurality of segments comprising electromagnetic reflecting materials of different thicknesses and sections, said plurality of segments include a plurality of inflatable sections which are coupled together to form a plurality of electromagnetic spectrum reflective cross sectional signal reflection profiles;

a plurality of reflective protrusions extending away from sections of one or more said plurality of segments, said plurality of reflective protrusions are formed to create a predetermined electromagnetic reflection from one or more predetermined electromagnetic signal sources comprising said system with said sensor;

a plurality of electromagnetic energy emitters and control systems coupled to two or more said plurality of segments of said inflatable structure configured to generate electromagnetic energy correlated to a predetermined electromagnetic energy pattern associated with at least one infrared and visual spectrum signatures associated with an object of interest;

one or more inflatable gas bags contained within said inflatable structure, said inflatable gas bags configured to stabilize said inflatable structure into a position forming said predetermined electromagnetic reflection;

a weighted cable connected to said first end and said second end of said inflatable structure, said weighted cable configured to keep uniform spacing between said first end and said second end and to stabilize said inflatable structure into said position forming said predetermined electromagnetic reflection; and a first and second tether sections adapted to couple said inflatable structure to a first mobile object and a second mobile objects;

wherein the inflatable structure comprises helium gas storage sections in addition to another type of gas;

inflating said inflatable structure with a heated buoyancy gas and orienting said inflatable structure with respect to said operator or system with said sensor, wherein the heated buoyancy gas inflates the inflatable structure into a specific shape along the inflatable structure associated with at least a portion of the infrared spectrum signature of the object of interest;

operating said first mobile object and said second mobile objects to move or position said inflatable structure; and operating said plurality of electromagnetic energy emitters to generate said predetermined electromagnetic energy pattern.

10. The method of claim 9, wherein said first and second tether sections couple with a fiber optic cable configured to receive transmissions from and communicate with the inflatable structure.

11. The method of claim 10, wherein said inflatable structure is powered by the fiber optic cable.

12. The method of claim 9, wherein said tether sections couple with a connective cable configured to provide strength so that the tether does not break or detach.

13. The method of claim 9, wherein said buoyancy gas comprises heated air or a lighter than air gas.

14. The method of claim 9, further comprising providing a first platform, said inflatable structure is selectively and detachably disposed on a portion of said first platform.

15. The method of claim 14, wherein said first platform comprises a ship hull and a deck.

16. The method of claim 9, wherein said first mobile objects and said second mobile objects each comprises an unmanned aerial vehicle, wherein said control system further comprises a communication system that communicates with an operator control station to receive instructions on maneuvering the inflatable structure with respect to the one or more predetermined electromagnetic signal sources that contributes to generating said first and second pluralities of predetermined electromagnetic reflections.

17. A method of manufacturing a system configured for attracting attention or focus of an operator or system with a sensor, comprising the steps of:

identifying an electromagnetic spectrum reflection profile of an object of interest that includes a cross-sectional profile of an electromagnetic spectrum signal return or reflection profile and an infrared signature associated with the object of interest;

shaping or forming an inflatable structure having a first end and a second end to generate at least a portion of said electromagnetic spectrum signal return or reflection profile, wherein said inflatable structure contains a plurality of segments, said plurality of segments comprising electromagnetic reflecting material sections of different thicknesses and sections configured to form or contribute at least in part to generating said electromagnetic spectrum signal return or reflection profile, wherein the inflatable structure comprises helium gas storage sections in addition to another type of gas;

attaching or forming a plurality of reflective protrusions to said inflatable structure extending away from said inflatable structure, said plurality of reflective protrusions configured to form or contribute at least in part to generating said electromagnetic spectrum signal return or reflection profile;

placing within or forming said inflatable structure to have one or more inflatable sections or gas bags, said inflatable sections or gas bags configured to orient said inflatable structure into a position or form forming or contributing at least in part to generation of said electromagnetic spectrum signal return or reflection profile;

providing an inflation system that provides heated gas into said inflatable structure so as to provide lighter than air gas into the inflatable structure so that the inflatable structure, once inflated, retains a specific shape along the inflatable structure associated with at least a portion of the infrared signature of the object of interest;

attaching a weighted cable to said first end and said second end of said inflatable structure, said weighted cable configured to maintain a form and distance relationship between said first end and said second end and to hold or orient said inflatable structure into said position or form forming or contributing at least in part to generation of said electromagnetic spectrum signal return or reflection profile;

coupling a selective detachment section between one of said first end or said second end of said inflatable structure and a first platform, said selective detachment section comprises a coupling or decoupling section which selectively decouples said first end or said second end of said inflatable structure from said first platform;

attaching a plurality of electromagnetic energy emitters onto said inflatable structure that generate electromagnetic energy configured to form at least in part or contribute to generation of said electromagnetic spectrum signal return or reflection profile; and attaching a first and second vehicle comprising communication, propulsion, and lift or floating systems to opposing ends of said inflatable structure, said first and second vehicles further comprise control instruction logic which is configured to maneuver the inflatable structure with respect to a second platform in a predetermined movement pattern or a movement pattern communicated to the first or second vehicles from a remote operator system, said second platform comprising a detection system that emits electromagnetic spectrum signals and detects at least part of said electromagnetic spectrum signal return or reflection profile reflections from said plurality of reflective protrusions and said electromagnetic reflecting material sections, wherein said predetermined movement pattern or said movement pattern communicated to the first or second vehicles comprises movement and orientation of the inflatable structure with respect to said second platform to maximize detection of said electromagnetic spectrum signal return or reflection profile.

18. The method of claim 17, wherein said electromagnetic spectrum signal return or reflection profile comprises a radar reflection return.

19. The method of claim 17, wherein said first and second vehicles each are unmanned aerial vehicles comprising lift and maneuver systems.

20. The method of claim 17, wherein said first and second vehicles are unmanned water vehicles.

21. The method of claim 17, further comprises coupling a third vehicle to a center section of the inflatable structure, said third vehicle comprising communication, propulsion, and control sections, said control section communicates with said first and second vehicles or a control section of at least said first platform to receive movement and orientation control instructions, said third vehicle configured to lift and orient a center section of the inflatable structure with respect to the first or second platforms.

22. A method of attracting attention of one or more entities, comprising the steps of: providing a ship;

providing a plurality of inflatable structures having a first end and a second end and adapted to float or become airborne upon inflation, each of said plurality of inflatable structures comprising:

a plurality of segments coupled together, said plurality of segments comprising electromagnetic reflecting materials of different thicknesses and sections, said plurality of segments include a plurality of inflatable sections which are coupled together to form a plurality of electromagnetic spectrum reflective cross sectional signal reflection profiles;

a plurality of reflective protrusions extending away from sections of one or more said plurality of segments, said reflective protrusions are formed to create a predetermined electromagnetic reflection from one or more predetermined electromagnetic signal sources comprising a system with said sensor;

a plurality of electromagnetic energy emitters and control systems coupled to two or more said plurality of segments of said inflatable structure configured to generate electromagnetic energy correlated to a predetermined electromagnetic energy pattern associated with at least one infrared and visual spectrum signatures associated with an object of interest;

one or more inflatable gas bags contained within said inflatable structure, said inflatable gas bags configured to stabilize said inflatable structure into a position forming said predetermined electromagnetic reflection;

a weighted cable connected to said first end and said second end of said inflatable structure, said weighted cable configured to keep uniform spacing between said first end and said second end and to stabilize said inflatable structure into said position forming said predetermined electromagnetic reflection;

a maneuvering system comprising a first and second maneuvering and propulsion system coupled to opposing ends of the inflatable structure, said maneuvering system comprising a control section and a communication section that maneuvers the inflatable structure with respect to the ship;

a first and second tether sections adapted to couple said inflatable structure to a first and a second mobile objects; and helium gas storage sections in addition to another type of gas;

coupling the plurality of inflatable structures to the ship; transiting the ship; detecting said entities;

inflating each said plurality of inflatable structures with a heated buoyancy gas and deploying the inflatable structures by detaching the inflatable structures from the ship, wherein the heated buoyancy gas inflates the inflatable structure into a specific shape along the inflatable structure associated with at least a portion of the infrared spectrum signature of the object of interest; and maneuvering the inflatable structures by the maneuvering systems to a plurality of predetermined distances from the ship, such that the ship cannot be visually sighted from a resulting position of each of the inflatable structures.

23. The method of claim 22, wherein said first and second maneuvering and propulsion systems respectively comprises a first and second unmanned aerial vehicle.

24. The method of claim 23, wherein said maneuvering system further comprises a third maneuvering and propulsion system coupled with a center section of said inflatable structure.

25. A method of providing and operating a system configured for attracting attention or focus of an operator or system with one or more sensors searching for an electromagnetic spectrum reflection profile of an object of interest that includes a cross-sectional profile of an electromagnetic spectrum signal emission, return or reflection profile, said method comprising the steps of:

providing one or more inflatable structures each comprising a first end and a second end to generate at least a portion of at least one electromagnetic spectrum signal emission, return or reflection profile, wherein said inflatable structure comprises:

a plurality of segments, said plurality of segments comprising electromagnetic reflecting material sections of different thicknesses and sections configured to form or contribute at least in part to generating said electromagnetic spectrum signal emission, return or reflection profile;

a plurality of reflective protrusions to said inflatable structure extending away from said inflatable structure, said plurality of reflective protrusions configured to form or contribute at least in part to generating said electromagnetic spectrum signal emission, return or reflection profile;

one or more inflatable sections or gas bags, said inflatable sections or gas bags configured to orient said inflatable structure into a position or form forming or contributing at least in part to generation of said electromagnetic spectrum signal emission, return or reflection profile;

a weighted cable to said first end and said second end of said inflatable structure, said weighted cable configured to maintain a form and distance relationship between said first end and said second end and to hold or orient said inflatable structure into said position or form forming or contributing at least in part to generation of said electromagnetic spectrum signal emission, return or reflection profile;

a selective detachment section between one of said first end or said second end of said inflatable structure and a first platform, said selective detachment section comprises a coupling or decoupling section which selectively decouples said first end or said second end of said inflatable structure from said first platform;

a plurality of electromagnetic energy emitters onto said inflatable structure that generate electromagnetic energy configured to form at least in part or contribute to generation of said electromagnetic spectrum signal emission, return or reflection profile, wherein the plurality of electromagnetic energy emitters comprise infrared and visible spectrum emitters; and a first and second vehicle comprising communication, propulsion, and lift or floating systems to opposing ends of said inflatable structure, said first and second vehicles further comprise control instruction logic which is configured to maneuver the inflatable structure with respect to a second platform having said operator or system with one or more sensors thereon in a predetermined movement pattern or a movement pattern communicated to the first or second vehicles from a remote operator system, said second platform comprising a detection system that emits electromagnetic spectrum signals and detects at least part of said electromagnetic spectrum signal emission, return or reflection profile reflections from said reflective protrusions and said electromagnetic reflecting material sections, wherein said predetermined movement pattern or said movement pattern communicated to the first or second vehicles comprises movement and orientation of the inflatable structure with respect to said second platform to maximize detection of said electromagnetic spectrum signal emission, return or reflection profile; and helium gas storage sections in addition to another type of gas;

transiting the first platform;

detecting said second platform;

inflating each said plurality of inflatable structures with a heated buoyancy gas and deploying the inflatable structures by detaching the inflatable structures from the first platform, wherein the heated buoyancy gas inflates the inflatable structure into a specific shape along the inflatable structure that is associated with at least a portion of an infrared spectrum signature portion of the electromagnetic spectrum signal emission, return or reflection profile; and maneuvering the inflatable structures using the first and second vehicles based on the predetermined movement pattern or the movement pattern communicated to the first or second vehicles from a remote operator system, wherein said predetermined movement pattern or the movement pattern communicated to the first or second vehicles comprise movement of each of the inflatable structures to a spaced apart plurality of predetermined distances from the first platform, such that the first platform cannot be visually sighted from a resulting position of each of the inflatable structures.

26. The method of claim 25, wherein said electromagnetic spectrum signal emission, return or reflection profile comprises a radar reflection return.

27. The method of claim 25 wherein said first and second vehicles each are unmanned aerial vehicles comprising lift and maneuver systems.

28. The method of claim 25, wherein said first and second vehicles are unmanned water vehicles.

29. The method of claim 25, further comprises coupling a third vehicle to a center section of the inflatable structure, said third vehicle comprising communication, propulsion, and control sections, said control section communicates with said first and second vehicles or a control section of at least said first platform to receive movement and orientation control instructions, said third vehicle configured to lift and orient a center section of the inflatable structure with respect to the first or second platforms.

* * * * *